US008662025B2

(12) United States Patent
Taki et al.

(10) Patent No.: US 8,662,025 B2
(45) Date of Patent: Mar. 4, 2014

(54) IGNITION PLUG COOLING DEVICE OF VEHICLE-USE ENGINE

(75) Inventors: Masafumi Taki, Saitama (JP); Yoshihiro Kitada, Saitama (JP); Toru Nishi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 402 days.

(21) Appl. No.: 13/052,518

(22) Filed: Mar. 21, 2011

(65) Prior Publication Data

US 2011/0232592 A1 Sep. 29, 2011

(30) Foreign Application Priority Data

Mar. 23, 2010 (JP) ..... 2010-066426

(51) Int. Cl.
*F01P 1/10* (2006.01)

(52) U.S. Cl.
USPC ..... 123/41.32

(58) Field of Classification Search
USPC ..... 123/41.31–41.33, 41.42, 41.61–41.62, 123/41.69–41.7, 90.22, 90.27, 90.31, 193.5, 123/41.82 R
See application file for complete search history.

(56) References Cited

U.S. PATENT DOCUMENTS 1,910,591 A * 5/1933 Chilton ..... 123/41.32
4,688,523 A 8/1987 Takahashi et al.
4,884,539 A * 12/1989 Ciccarone et al. ..... 123/310
4,972,807 A * 11/1990 Morishita ..... 123/41.82 R
5,269,243 A * 12/1993 Mochizuki ..... 123/41.55
5,301,641 A * 4/1994 Kasai et al. ..... 123/193.5
6,035,824 A * 3/2000 Lee ..... 123/295
6,745,741 B2 * 6/2004 Liu ..... 123/196 R
6,988,573 B2 * 1/2006 Tsuruta et al. ..... 180/68.1

FOREIGN PATENT DOCUMENTS

CN 101111669 A 1/2008
JP 2004138053 A * 5/2004 ..... F01P 1/02
JP 2004232478 A * 8/2004 ..... F02P 15/08
JP 4209440 B2 10/2008

* cited by examiner

*Primary Examiner* — Hung Q Nguyen
(74) *Attorney, Agent, or Firm* — Birch, Stewart, Kolasch & Birch, LLP

(57) ABSTRACT

An ignition plug cooling device of a vehicle engine for efficiently cooling the ignition plugs while increasing the freedom in the arrangement of the ignition plugs. A vehicle engine includes a first ignition plug and a second ignition plug for making respective electrodes thereof face a combustion chamber and are mounted on a cylinder head. An air flow passage through which a flow of air passes and a cooling oil chamber through which lubrication oil for the engine passes are formed in the cylinder head. The first ignition plug is arranged in the air flow passage to enable a cooling of the first ignition plug by the flow of air which passes through the air flow passage. The second ignition plug is arranged adjacent to the cooling oil chamber to enable a cooling of an area around the second ignition plug by oil which passes through the cooling oil chamber.

20 Claims, 10 Drawing Sheets

IGNITION PLUG COOLING DEVICE OF VEHICLE-USE ENGINE

CROSS-REFERENCE TO RELATED APPLICATIONS

The present application claims priority under 35 USC 119 to Japanese Patent Application No. 2010-066426 filed on Mar. 23, 2010 the entire contents of which are hereby incorporated by reference.

BACKGROUND OF THE INVENTION

1. Field of the Invention

The present invention relates to an improvement of an ignition plug cooling device of a vehicle engine in which a first ignition plug and a second ignition plug which make respective electrodes thereof face a combustion chamber are mounted on a cylinder head having the combustion chamber and an intake port and an exhaust port which open in the combustion chamber.

2. Description of Background Art

An engine for a vehicle such as a motorcycle is known for enhancing output performance and low fuel consumption by increasing combustion efficiency. See, for example, Japanese Patent No. 4209440. A vehicle engine is known wherein a pair of first and second ignition plugs which makes respective electrodes thereof face a combustion chamber is mounted on a cylinder head, and the first and second ignition plugs are respectively arranged on an inlet side and an outlet side of an air flow passage which is formed in the cylinder head so as to allow a flow of air to pass therethrough for cooling the first and second ignition plugs.

In the above-mentioned conventional ignition plug cooling device of the vehicle engine, since the pair of ignition plugs is arranged in one air flow passage, the cooling property of the second ignition plug arranged on an outlet side of the air flow passage is inevitably inferior to the cooling property of the first ignition plug arranged on an inlet side of the air flow passage. However, the actual circumstance is that there is not a sufficient space in the cylinder head which allows the formation of two independent air flow passages which individually cool the first and second ignition plugs.

SUMMARY AND OBJECTS OF THE INVENTION

The present invention has been made under such circumstances, and it is an object of the present invention to provide an ignition plug cooling device of a vehicle engine which can efficiently cool both the first and second ignition plugs while increasing the degree of freedom in the arrangement of the first and second ignition plugs.

To achieve the above-mentioned object, an embodiment of the present invention is directed to an ignition plug cooling device of a vehicle engine in which a first ignition plug and a second ignition plug which make respective electrodes thereof face a combustion chamber are mounted on a cylinder head having the combustion chamber and an intake port and an exhaust port which open in the combustion chamber, wherein the first technical feature lies in that an air flow passage through which a flow of air passes and a cooling oil chamber through which lubrication oil for the engine passes are formed in the cylinder head. The first ignition plug is arranged in the air flow passage so as to enable cooling of the first ignition plug by the flow of air which passes through the air flow passage, and the second ignition plug is arranged adjacent to the cooling oil chamber so as to enable cooling of an area around the second ignition plug by oil which passes through the cooling oil chamber.

Further, the second technical feature of an embodiment of the present invention lies in that an upstream end of the intake port is opened on a back surface of the cylinder head which faces a rear side of a vehicle, a downstream end of the exhaust port is opened on a front surface of the cylinder head which faces a front side of the vehicle, an inlet of the air flow passage is opened on a front surface of the cylinder head such that the inlet is arranged adjacent to one side of the exhaust port, an outlet of the air flow passage is opened on one side surface of the cylinder head in a lateral direction, the outlet constitutes a first insertion recessed portion for inserting the first ignition plug to be arranged in the air flow passage, and a second insertion recessed portion for inserting the second ignition plug is opened on the back surface of the cylinder head such that the second insertion recessed portion is arranged adjacent to one side of the intake port.

According to an embodiment of the present invention, the exhaust port is formed such that a downstream end of the exhaust port is inclined toward a timing power transmission chamber for operating valves which is formed on one side portion of the cylinder head in a lateral direction, and the air flow passage is arranged on a side opposite to the timing power transmission chamber with the exhaust port sandwiched between the timing power transmission chamber and the air flow passage.

According to an embodiment of the present invention, the second ignition plug is formed between the intake port and the timing power transmission chamber which is formed on one side portion of the cylinder head in a lateral direction.

According to an embodiment of the present invention, the cooling oil chamber is arranged between a pair of left and right camshaft holders which is formed on the cylinder head and rotatably supports a valve operating camshaft, and the second ignition plug is arranged directly below the cooling oil chamber.

According to an embodiment of the present invention, the air flow passage and the cooling oil chamber for cooling the first and second ignition plugs respectively can be relatively freely formed in the cylinder head corresponding to the arrangement of the first and second ignition plugs. Accordingly, it is possible to effectively cool the first and second ignition plugs individually while increasing the degree of freedom in the arrangement of the first and second ignition plugs so that the durability of the first and second ignition plugs can be enhanced. Thus, eventually, contributing to the enhancement of output performance and low fuel consumption of the engine. More particularly, the second ignition plug is cooled by oil. Thus, the second ignition plug can be easily mounted on a portion of the cylinder head where a flow of air hardly passes.

According to an embodiment of the present invention, the inlet of the air flow passage is opened on the front surface of the cylinder head such that the inlet is arranged adjacent to the exhaust port and, at the same time, the outlet of the air flow passage is opened on one side surface of the cylinder head in the lateral direction, and the outlet constitutes the first plug insertion recessed portion for the first ignition plug. Accordingly, the first ignition plug can be easily mounted on or dismounted from one side of the cylinder head in the lateral direction whereby the first ignition plug possesses an extremely excellent maintenance property. On the other hand, the second plug insertion recessed portion for the second ignition plug is formed on the back surface of the cylinder head such that the second plug insertion recessed portion is opened adjacent to the intake port. Thus, the second ignition plug can be easily mounted on or dismounted from the back surface side of the cylinder head whereby the second ignition plug possesses an extremely excellent maintenance property.

According to an embodiment of the present invention, the inlet of the air flow passage can be largely opened without being obstructed by the exhaust port. Due to such a construction, a flow rate of the flow of air which passes through the air flow passage can be increased. Thus, it is possible to enhance the cooling property of the first ignition plug.

According to an embodiment of the present invention, the second insertion recessed portion is arranged so as to be interposed between the intake port and the timing power transmission chamber. Thus, the second insertion recessed portion can be formed by effectively making use of a dead space formed between the intake port and the timing power transmission chamber thus obviating the large-sizing of the cylinder head.

According to an embodiment of the present invention, it is possible to easily form the cooling oil chamber having a sufficient capacity on the bottom surface of the valve operating chamber whereby the cooling property of the second ignition plug can be further enhanced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinafter, an embodiment of the present invention is explained in conjunction with attached drawings.

In FIG. 1 to FIG. 4, an engine body Ea of an engine E which is mounted on a motorcycle is constituted of a crankcase 1, a cylinder block 2 which is joined to an upper surface of the crankcase 1 in an erected manner using bolts, and a cylinder head 3 which is joined to an upper end surface of the cylinder block 2 using bolts. A head cover 4 is joined to an upper end surface of the cylinder head 3 using bolts.

In the following explanation, the directions of "front and rear" and "left and right" correspond to the directions of "front and rear" and "left and right" of the motorcycle with the engine E mounted thereon.

Further, the above-mentioned crankcase 1 includes a left case body 1*a* and a right case body 1*b* which are joined to each other using bolts, a left case cover 1*c* which is joined to an outer end surface of the left case body 1*a* using bolts, and a right case cover 1*d* which is joined to an outer end surface of the right case body 1*b* using bolts.

Figure 4:
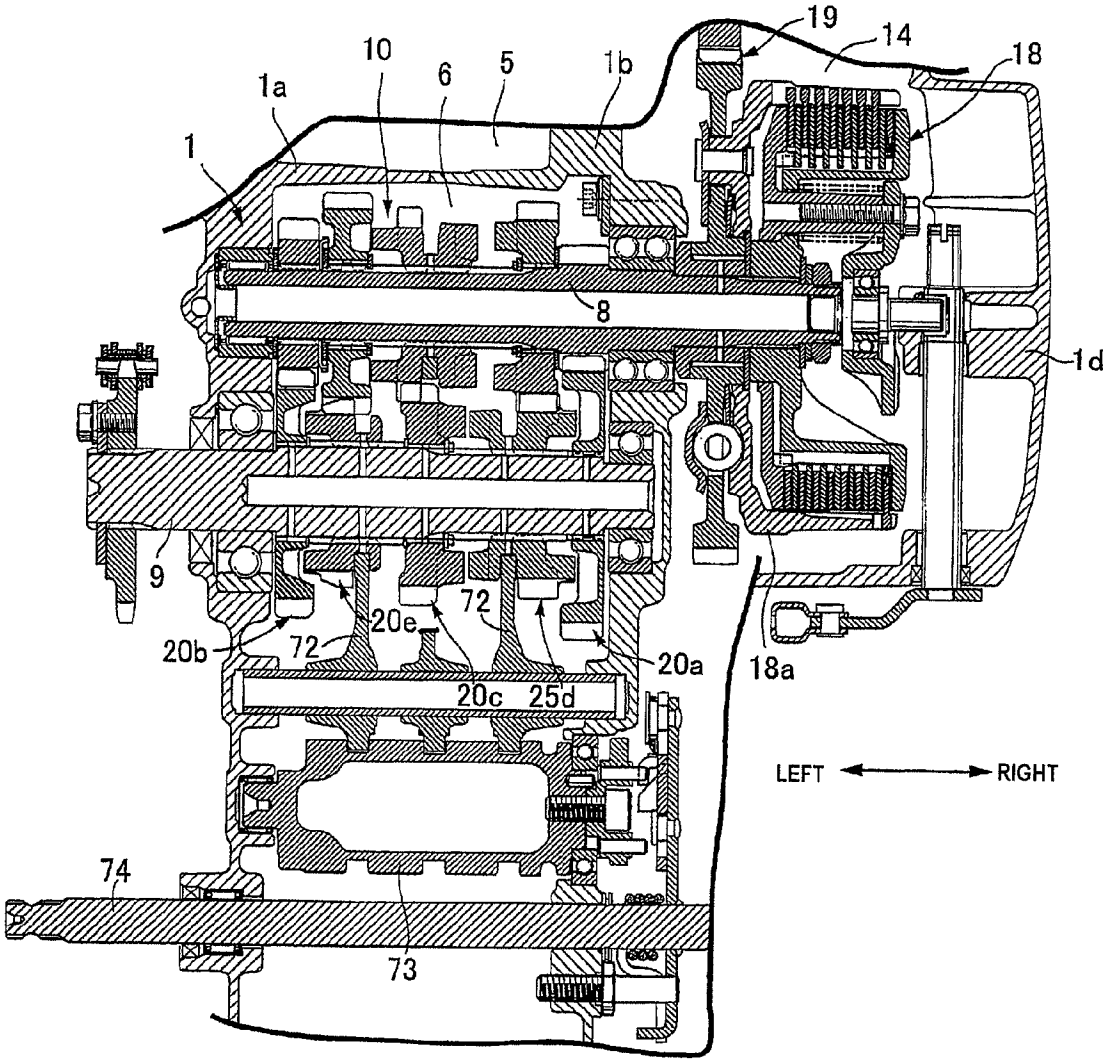
FIG. 4 is a cross-sectional view taken along a line 4-4 in FIG. 1.

Between the left and right case bodies 1*a*, 1*b*, a crank chamber 5 and a transmission chamber 6 are defined which are arranged behind and adjacent to the crank chamber 5 with a partition wall sandwiched therebetween (see FIG. 4). In the crank chamber 5, a crankshaft 7 is housed which has both end portions thereof supported on the left and right case bodies 1*a*, 1*b*. In the transmission chamber 6, a transmission 10 is housed which is provided with an input shaft 8 and an output shaft 9 having both end portions thereof supported on the left and right case bodies 1*a*, 1*b*. A bottom portion of the transmission chamber 6 is formed deeper than the crank chamber 5 thus forming an oil reservoir 11 (see FIG. 1) for storing a predetermined quantity of lubrication oil 12.

Figure 1:
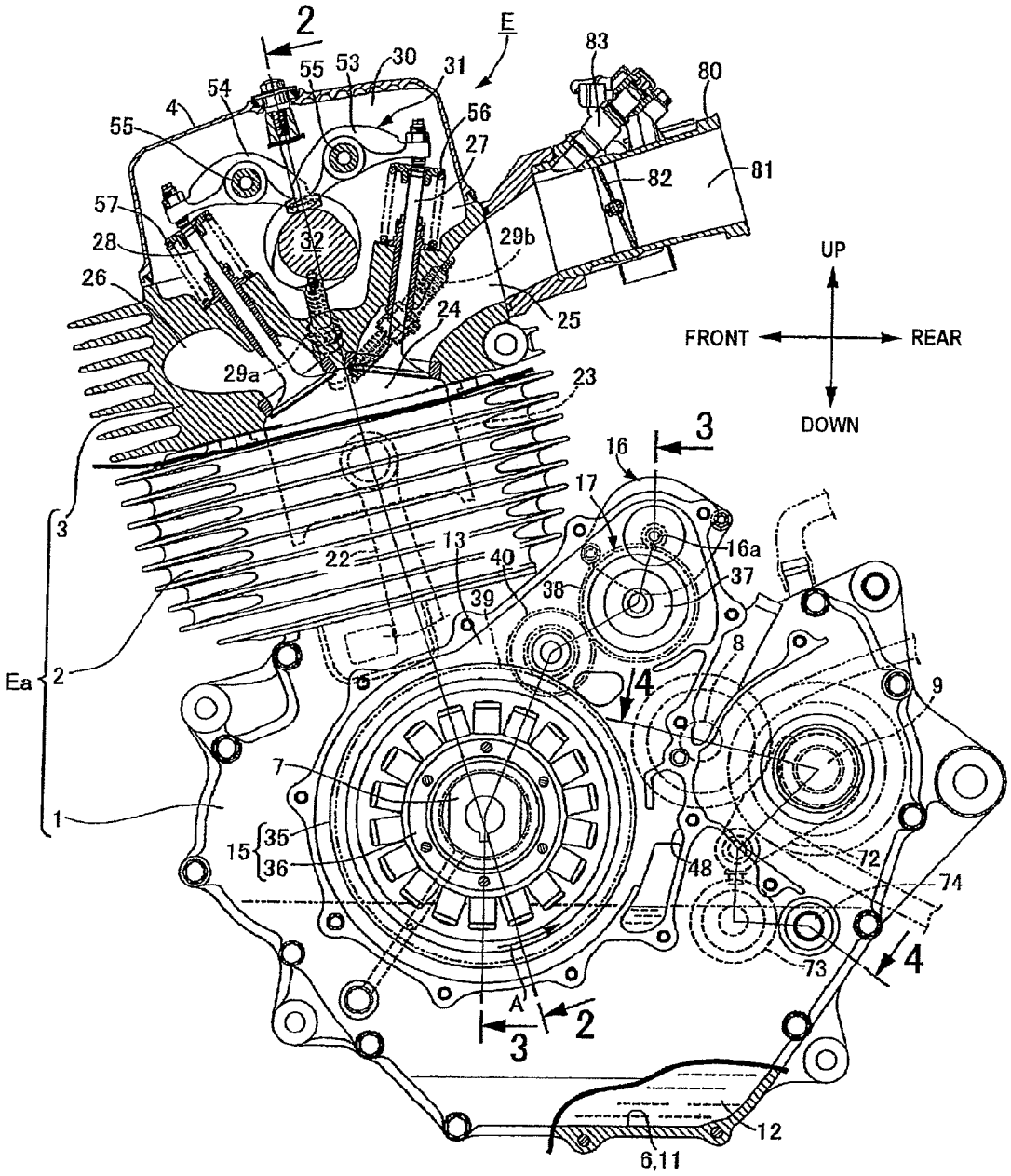
FIG. 1 is a side view with a part broken away of a motorcycle-use engine according to the present invention.
Figure 2:
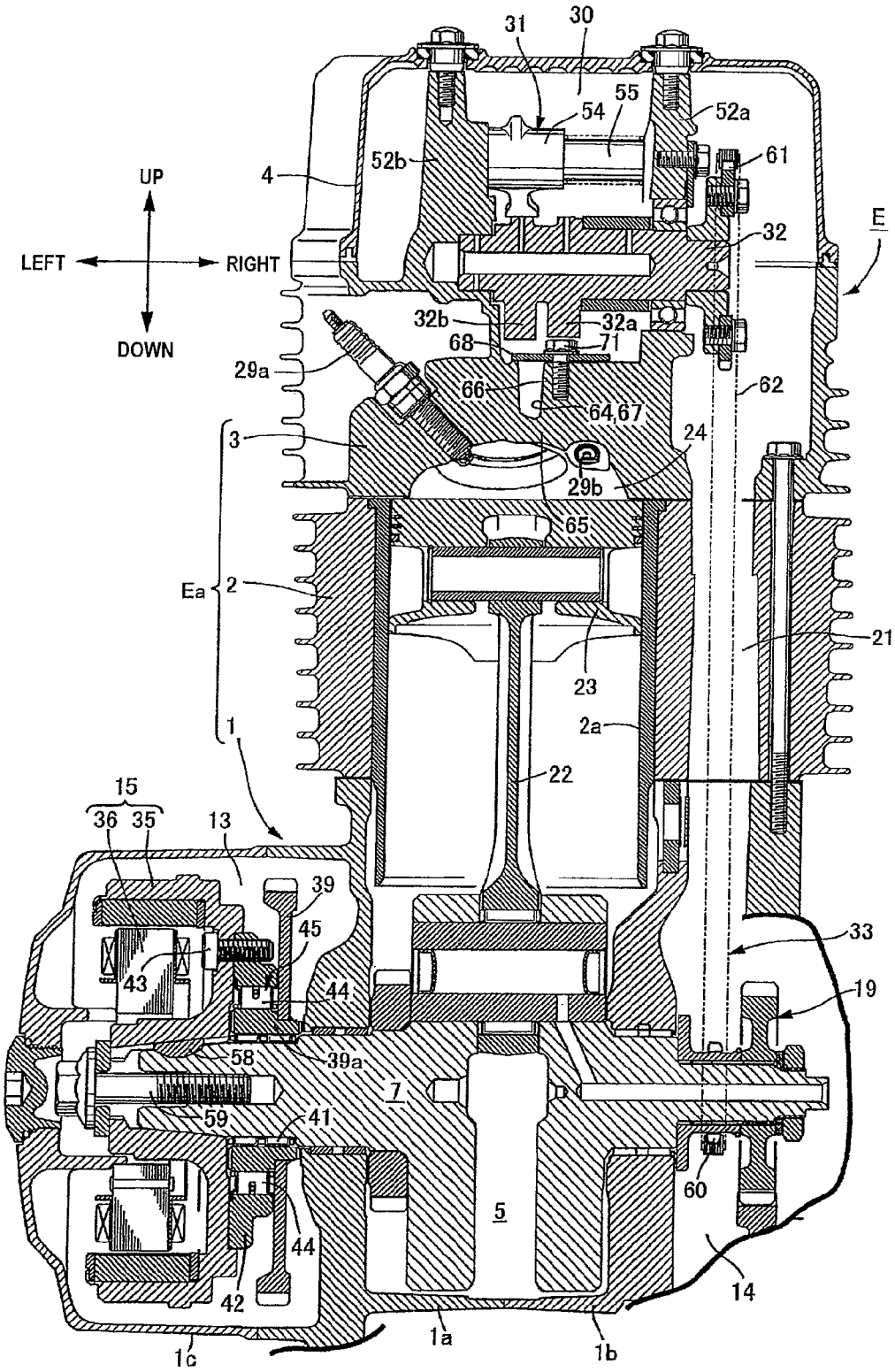
FIG. 2 is a cross-sectional view taken along a line 2-2 in FIG. 1.
Figure 3:
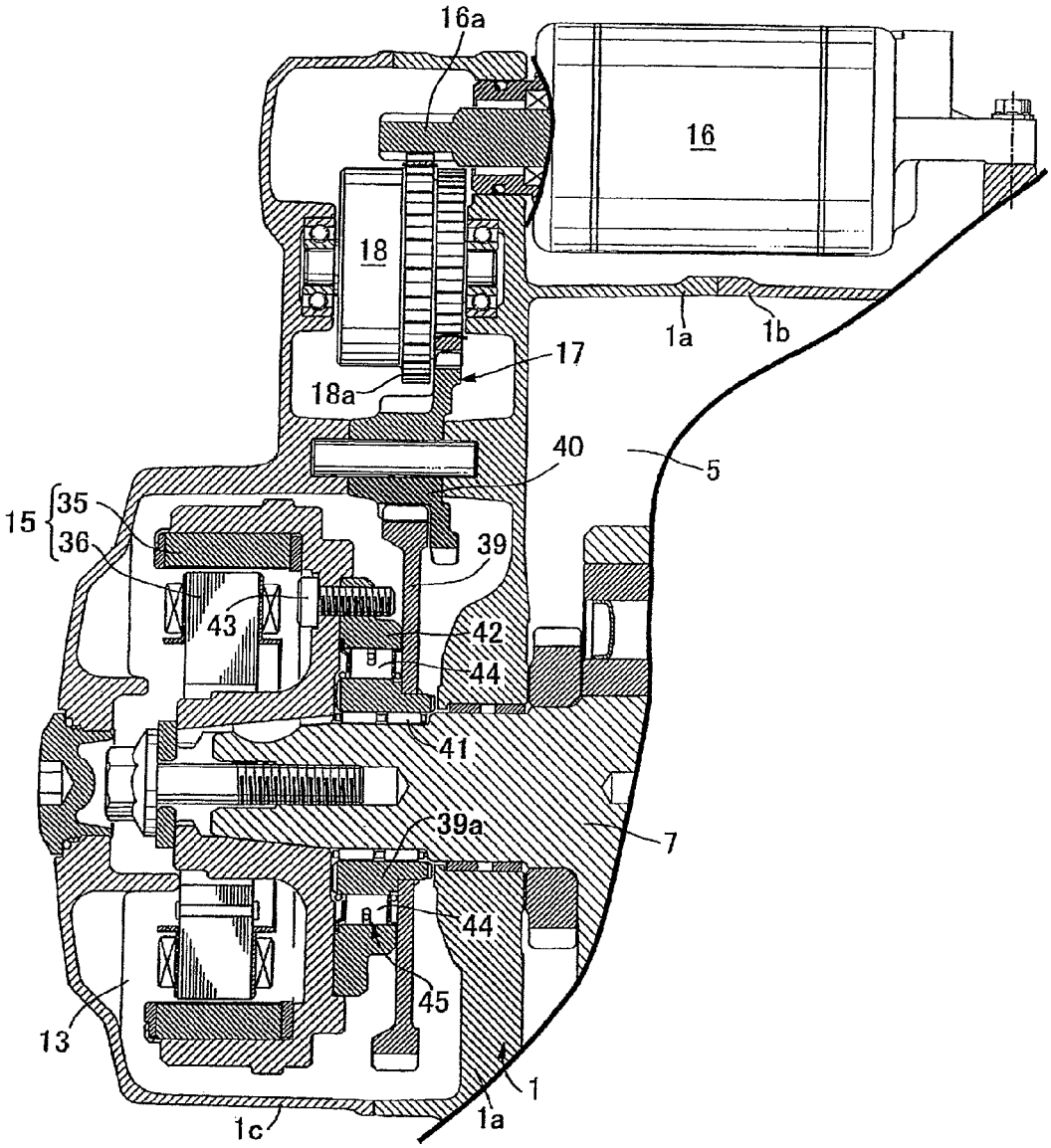
FIG. 3 is a cross-sectional view taken along a line 3-3 in FIG. 1.

As shown in FIG. 1 to FIG. 3, an auxiliary machine chamber 13 is defined between the left case body 1*a* and the left case cover 1*c*, and a first power transmission chamber 14 is defined between the right case body 1*b* and the right case cover 1*d* respectively. As shown in FIG. 1 and FIG. 3, in the auxiliary machine chamber 13, a generator 15 is housed which is driven by the crankshaft 7 together with a starting gear mechanism 17 which connects an output shaft 16*a* of a starting motor 16 which is mounted on an upper outer wall of the crankcase 1 and the crankshaft 7 to each other. In the first power transmission chamber 14, a wet-type multiple disc clutch 18 which is mounted on the input shaft 8, and a primary power transmission gear train 19 which connects a clutch outer 18*a* which constitutes an input member of the clutch 18 and the crankshaft 7 to each other are housed.

As shown in FIG. 1 and FIG. 4, the transmission 10 is of a known multi-stage type and is constituted of transmission gear trains 20*a* to 20*e* in a plurality of stages which are arranged on the input shaft 8 and the output shaft 9 in an extending manner and each of which is established by selection, a plurality of shift forks 72 which are operated for selectively establishing the transmission gear trains 20*a* to 20*e*, a shift drum 73 which drives the shift forks 72, and a change spindle 74 which rotatably operates the shift drum 73.

As illustrated in FIG. 1 and FIG. 2, a cylinder sleeve 2*a* is inserted in the cylinder block 2 by casting, and a piston 23 which is connected to the crankshaft 7 by way of a connecting rod 22 is fitted in the cylinder sleeve 2*a*. A timing power transmission chamber 21 which is arranged adjacent to a right side of the cylinder sleeve 2*a* and in communication with the first power transmission chamber 14 is formed in an extended manner between and over the crankcase 1 and the cylinder block 2.

Figure 5:
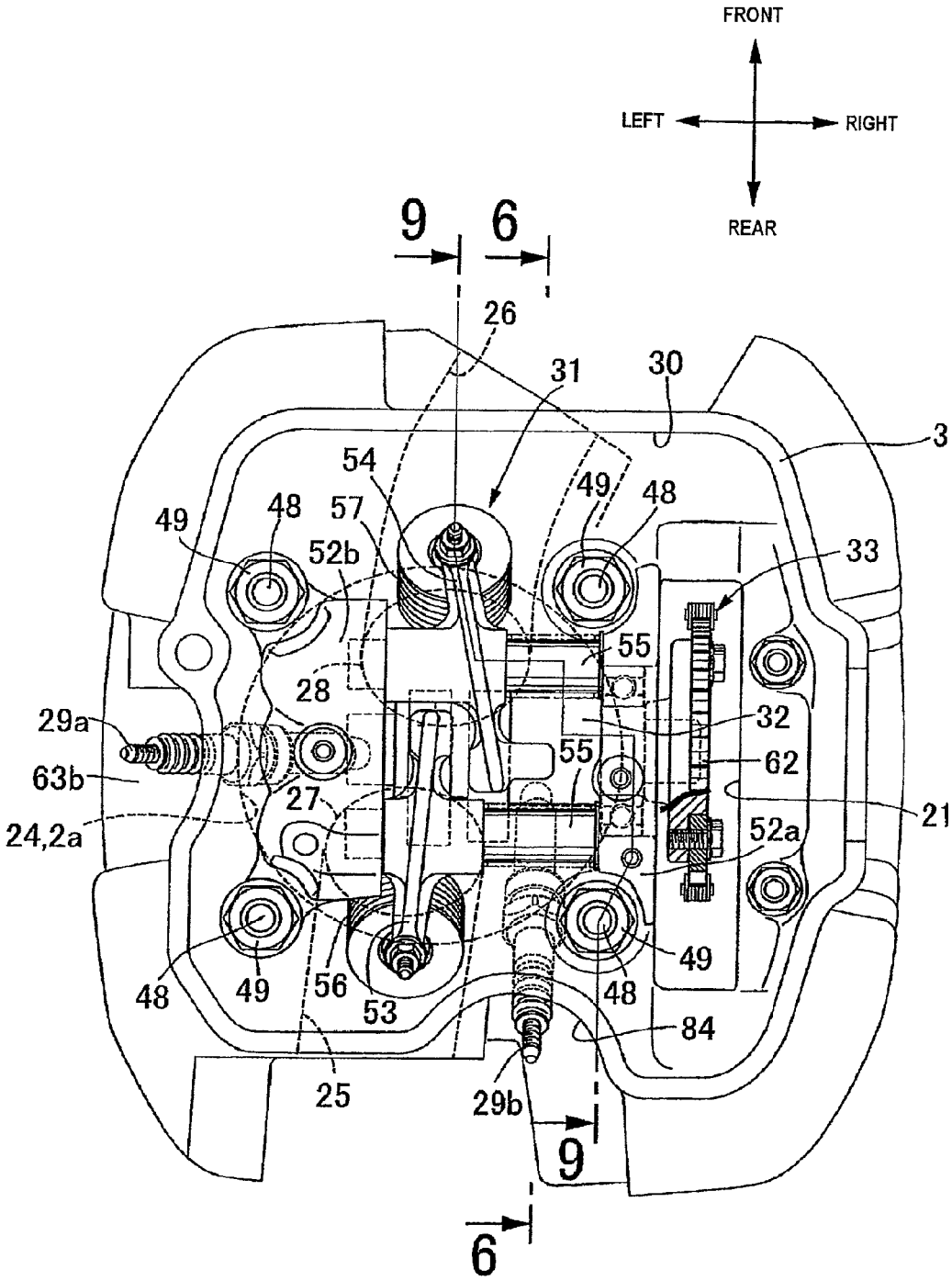
FIG. 5 is a plan view of the engine which is in a state where a head cover is removed.
Figure 6:
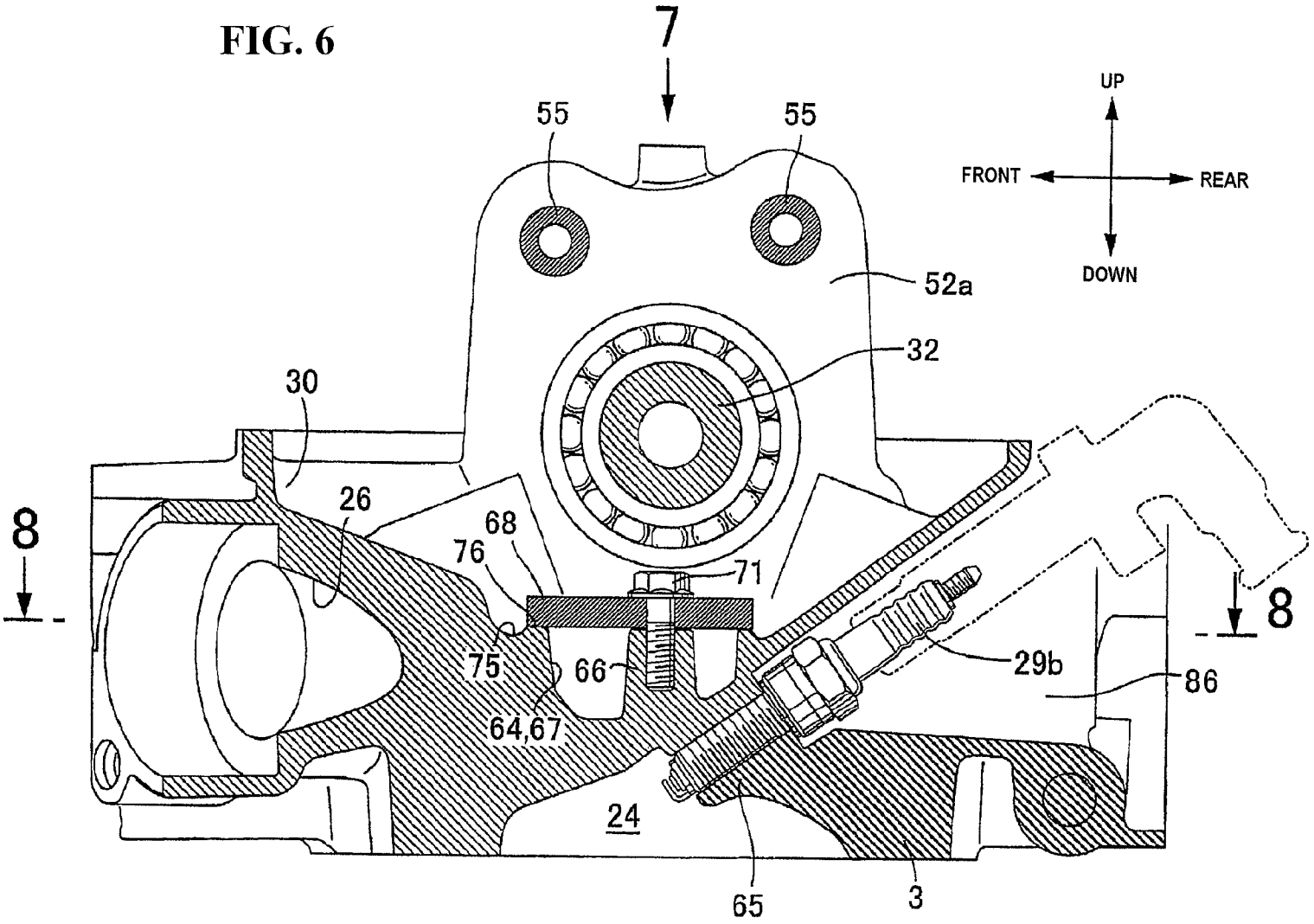
FIG. 6 is a cross-sectional view taken along a line 6-6 in FIG. 5.
Figure 7:
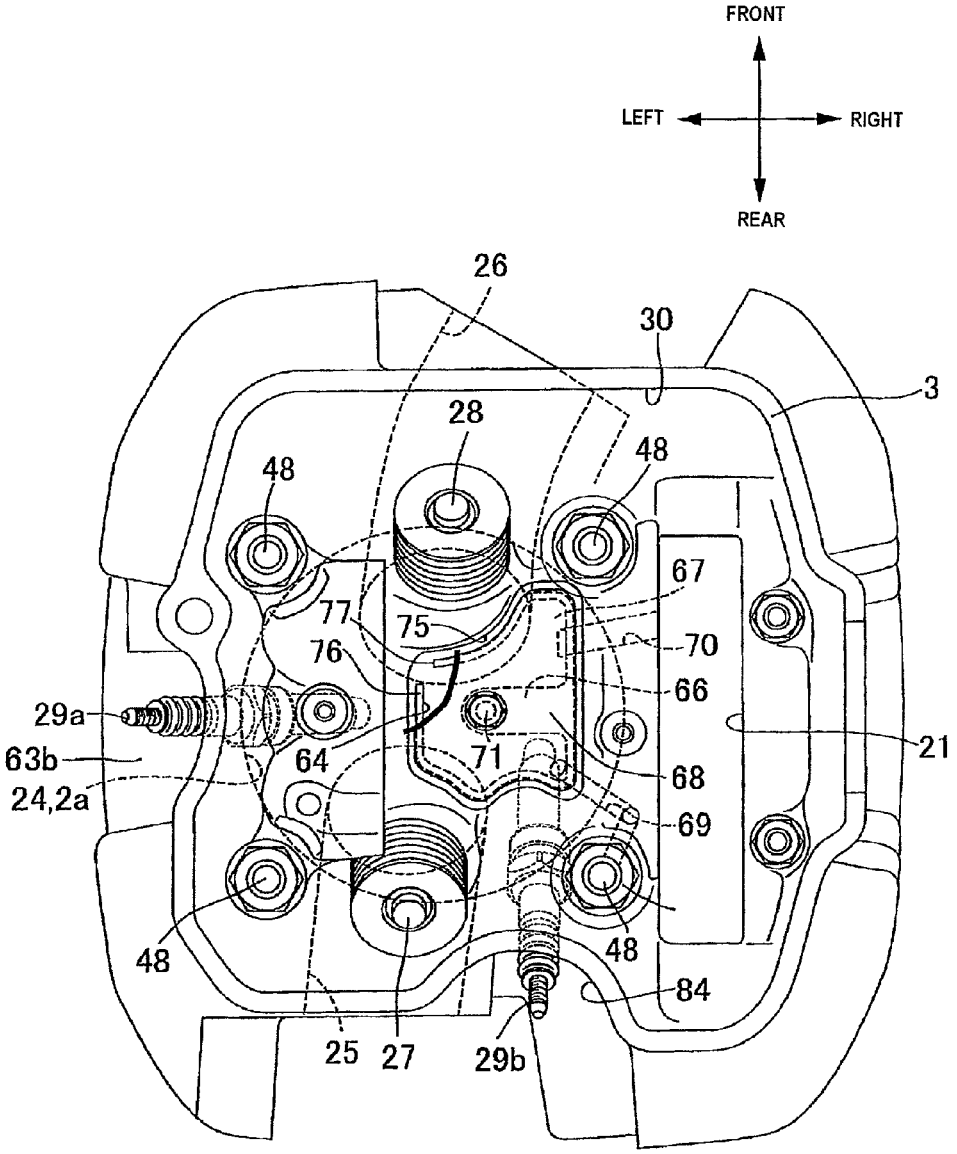
FIG. 7 is a view of the engine as viewed in the direction indicated by an arrow 7 in FIG. 6.
Figure 8:
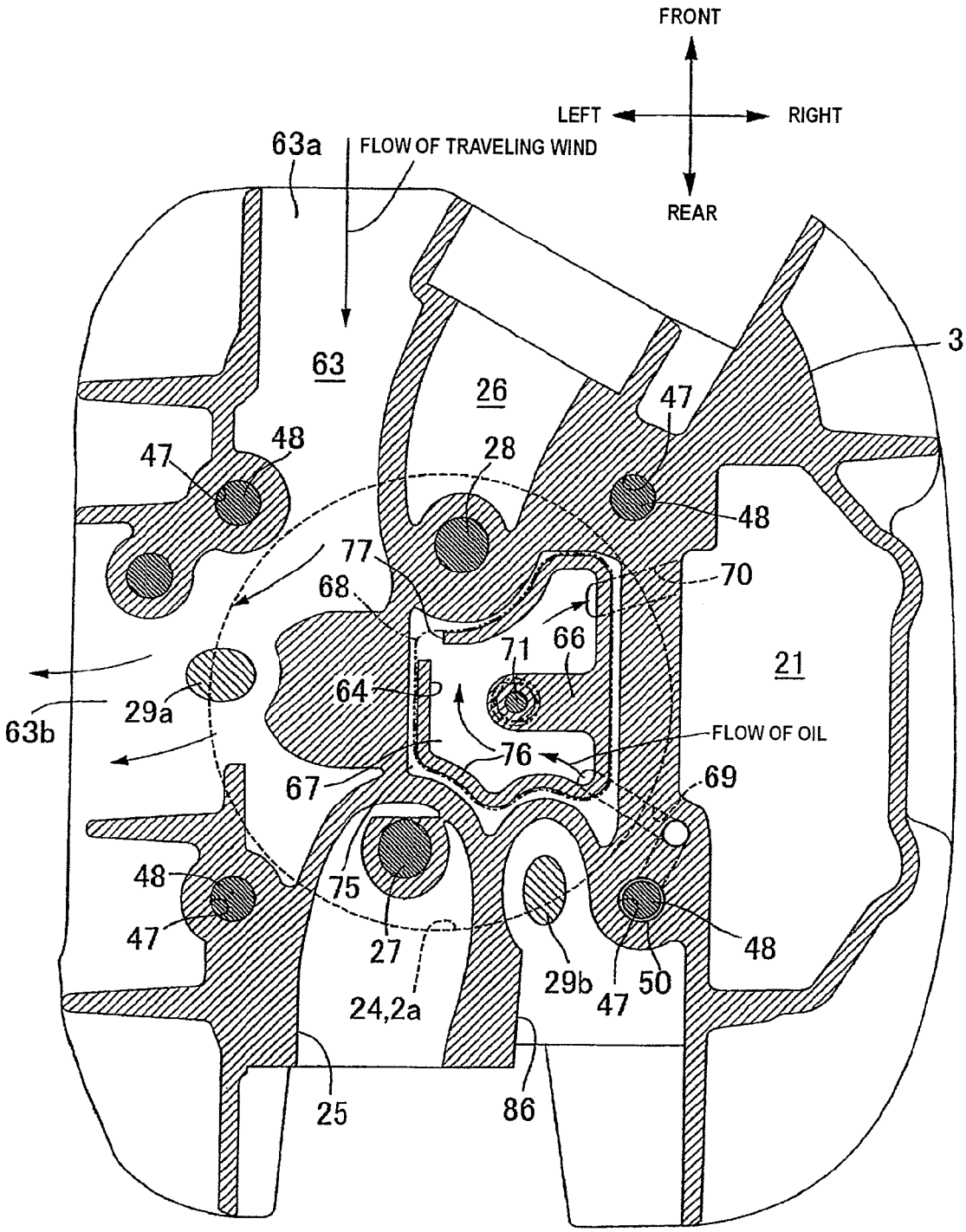
FIG. 8 is an enlarged cross-sectional view taken along a line 8-8 in FIG. 6.
Figure 9:
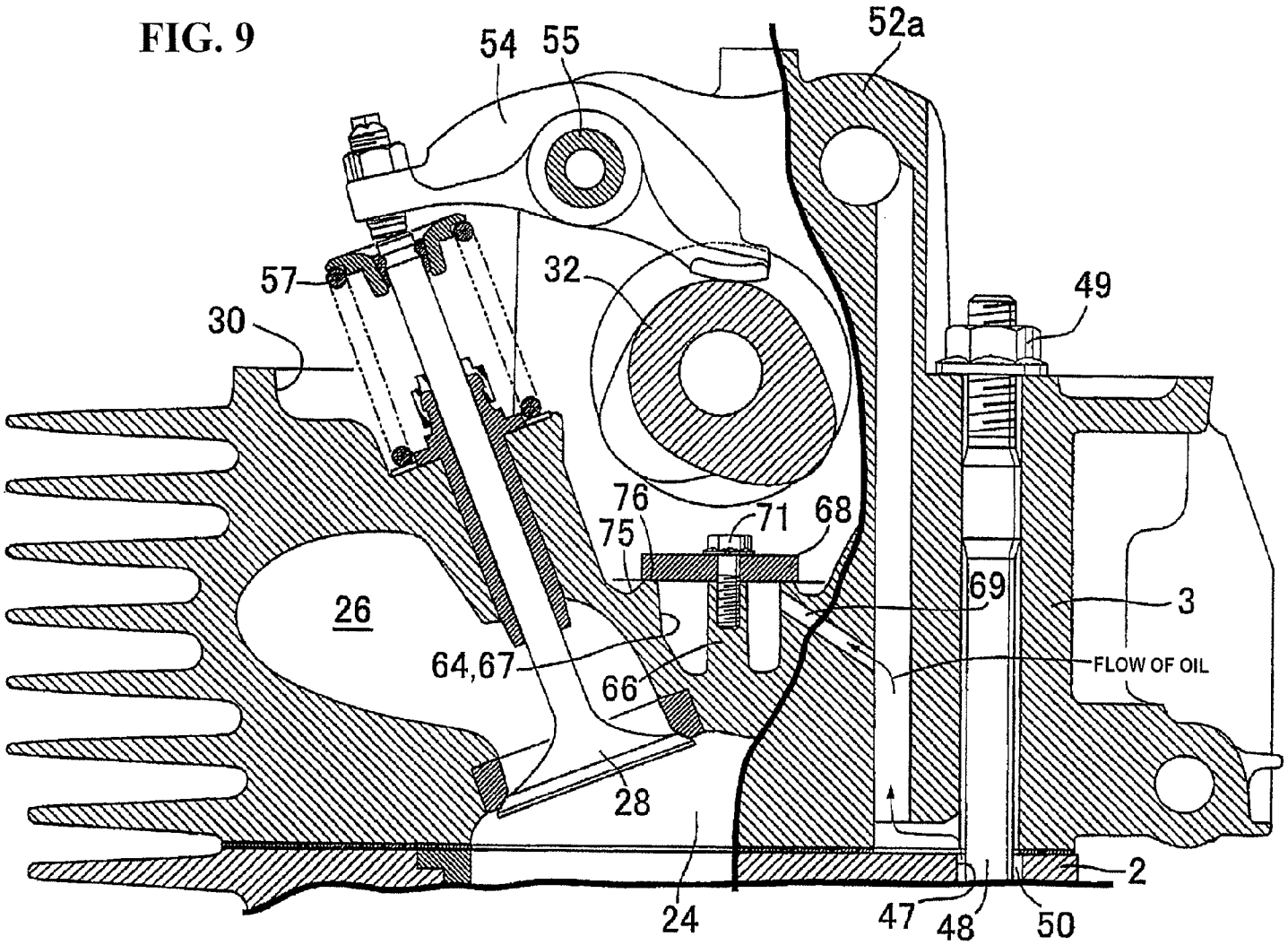
FIG. 9 is a cross-sectional view taken along a line 9-9 in FIG. 5.
Figure 10:
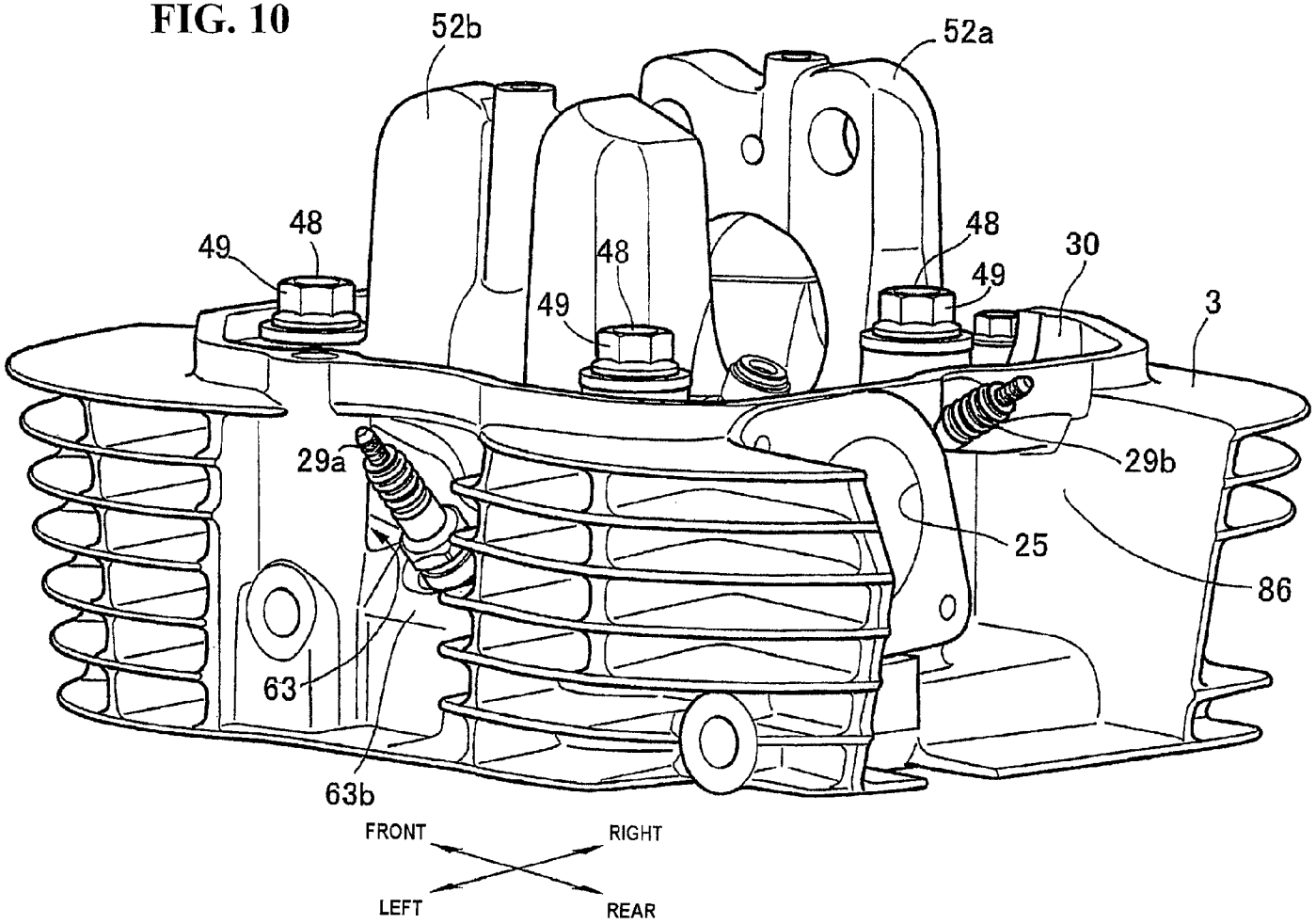
FIG. 10 is a perspective view of a cylinder head of the engine.

As shown in FIG. 5, FIG. 8 and FIG. 9, in the cylinder block 2 and the cylinder head 3, a plurality of bolt penetrating holes 47 are formed in a state where the bolt penetrating holes 47 surround the cylinder sleeve 2*a*. A plurality of stud bolts 48 which are mounted on upper end surfaces of the left and right case bodies 1*a*, 1*b* are inserted into the respective bolt penetrating holes 47, and nuts 49 are threadedly engaged with and fastened to the stud bolts 48 on an upper surface side of the cylinder head 3 whereby the cylinder block 2 and the cylinder head 3 are fastened to the crankcase 1. Between peripheral surfaces of some stud bolts 48 and peripheral surfaces of some bolt penetrating holes 47 which face each other in an opposed manner, a cylindrical oil passage 50 is defined which is used when oil in the oil reservoir 11 is sucked by an oil pump (not shown in the drawing) and is supplied to a valve operating chamber 30 side described later.

As shown in FIG. 1, FIG. 2 and FIG. 5, in the cylinder head 3, a combustion chamber 24 which is in communication with the inside of the cylinder sleeve 2*a*, an intake port 25 which is opened in the combustion chamber 24 from a rear side, and an exhaust port 26 which is opened in the combustion chamber 24 from a front side are formed. Due to such a construction, an upstream end of the intake port 25 is opened on a back surface of the cylinder head 3, and a throttle body 80 having an intake air duct 81 which is in communication with the upstream end of the intake port 25 is mounted on the back surface of the cylinder head 3. The throttle body 80 is provided with a throttle valve 82 which opens and closes the intake air duct 81 and a fuel injection valve 83 which injects fuel toward the intake port 25. On the other hand, a downstream end of the exhaust port 26 is opened on a front surface of the cylinder head 3, and an exhaust pipe (not shown in the drawing) which is in communication with the downstream end of the exhaust port 26 is mounted on a front surface of the cylinder head 3.

The valve operating chamber 30 which is in communication with the timing power transmission chamber 21 is defined between the cylinder head 3 and the head cover 4, and a valve operating mechanism 31 which opens and closes intake and exhaust valves 27, 28 is housed in the valve operating chamber 30. The valve operating mechanism 31 includes a camshaft 32 which is rotatably supported on a pair of left and right camshaft holders 52*a*, 52*b* which is integrally formed on an upper surface of the cylinder head 3 in a projecting manner and is arranged parallel to the crankshaft 7, an intake rocker arm 53 which transmits a lift operation of the intake cam 32*a* of the camshaft 32 to the intake valve 27 thus opening the intake valve 27, an exhaust rocker arm 54 which transmits a lift operation of the exhaust cam 32*b* of the camshaft 32 to the exhaust valve 28 thus opening the exhaust valve 28, and an intake valve spring 56 and an exhaust valve spring 57 which bias the intake valve 27 and the exhaust valve 28 in the valve closing direction respectively. The intake and exhaust rocker arms 53, 54 are supported in a rockable manner on rocker shafts 55, 55 which are supported on the camshaft holders 52*a*, 52*b* parallel to the camshaft 32 respectively.

The above-mentioned camshaft 32 is connected to the crankshaft 7 by way of a timing power transmission device 33 arranged in the timing power transmission chamber 21. The timing power transmission device 33 includes a drive sprocket 60 which is fixed to the crankshaft 7, a driven sprocket 61 which is fixed to an end portion of the camshaft 32 which projects toward a right-side surface side of the right camshaft holder 52*a* and has teeth the number of which is twice as large as the number of teeth of the drive sprocket 60, and a chain 62 which extends between both sprockets 60, 61. The timing power transmission device 33 transmits the rotation of the crankshaft 7 to the camshaft 32 while halving a rotational speed.

As illustrated in FIG. 1 and FIG. 2, the generator 15 is formed of an outer-rotor-type generator and includes a cylindrical outer rotor 35 which is fitted on a left end portion of the crankshaft 7 by a taper fitting and is fixed to the left end portion of the crankshaft 7 by a key 58 and a bolt 59, and a stator 36 which is connected to an inner wall of the left case cover 1*c* using a bolt and is arranged in the inside of the outer rotor 35.

Further, as shown in FIG. 3, the starting gear mechanism 17 includes a torque limiter 37 which is driven by the output shaft 16*a* of the starting motor 16. An output gear 38 of the torque limiter 37 is meshed with a ring gear 39 which is rotatably supported on the crankshaft 7 by way of an intermediate gear 40. The ring gear 39 includes a hub 39*a* which is rotatably supported on the crankshaft 7 by way of a needle bearing 41. The hub 39*a* and an outer ring 42 which concentrically surrounds the hub 39*a* are fixed to the outer rotor 35 using a bolt 43. The hub 39*a*, the outer ring 42 and a plurality of springs 44 which are interposed between the hub 39*a* and the outer ring 42 constitute a one-way clutch 45 which assumes an engagement state only when the ring gear 39 is rotated in the normal direction (in the rotational direction A of the crankshaft 7, see FIG. 1). Accordingly, when the ring gear 39 is rotated in the normal direction by operating the starting motor 16, a rotational torque of the ring gear 39 is transmitted to the outer rotor 35 and the crankshaft 7 by way of the one-way clutch 45 thus cranking the engine E whereby the engine E can be started. After starting the engine, since the one-way clutch 45 is in a disengagement state, there is no transmission of rotation from the crankshaft 7 to the ring gear 39.

As shown in FIG. 2, FIG. 5 to FIG. 10, a pair of first and second ignition plugs 29*a*, 29*b* is threadedly mounted on the cylinder head 3 in a state where electrodes of the respective ignition plugs 29*a*, 29*b* face the combustion chamber 24. The first ignition plug 29*a* is threadedly mounted on the cylinder head 3 from a left-side surface side of the cylinder head 3, and the second ignition plug 29*b* is threadedly mounted on the cylinder head 3 from a back surface side of the cylinder head 3. The first ignition plug 29*a* is arranged in an air flow passage 63 which is formed in the cylinder head 3 for cooling the first ignition plug 29*a* by flow of air.

To be more specific, the exhaust port 26 is formed such that a downstream end of the exhaust port 26 is inclined toward a timing power transmission chamber 21 side and is opened on a front surface of the cylinder head 3 (see FIG. 8). The air flow passage 63 is formed into an approximately L shape such that an inlet 63*a* of the air flow passage 63 is opened on the front surface of the cylinder head 3 on a side opposite to the timing power transmission chamber 21 with the exhaust port 26 sandwiched between the inlet 63*a* and the timing power transmission chamber 21, more specifically, adjacent to a left side of the exhaust port 26, and an outlet 63*b* of the air flow passage 63 is opened on a left-side surface of the cylinder head 3 on a side opposite to the timing power transmission chamber 21. The outlet 63*b* is used also as a first insertion recessed portion 63*b* for the first ignition plug 29*a*. Accordingly, the first ignition plug 29*a* is threadedly mounted on the cylinder head 3 in a state where the first ignition plug 29*a* is inserted into the outlet 63*b* of the air flow passage 63.

Further, during traveling of the vehicle on which the engine E is mounted, a flow of air which impinges on the front surface of the engine E flows through the air flow passage 63 from the inlet 63*a* to the outlet 63*b* and hence, the flow of air can effectively cool the first ignition plug 29*a* which is arranged in the air flow passage 63.

On the other hand, the second ignition plug 29*b* is threadedly mounted on a partition wall 65 between a cooling oil chamber 64 which is formed on a bottom surface of the valve operating chamber 30 and the combustion chamber 24 so that the second ignition plug 29*b* is arranged directly below the cooling oil chamber 64. The cooling oil chamber 64 is formed on the bottom surface of the valve operating chamber 30 by indentation between the pair of left and right camshaft holders 52*a*, 52*b*. By forming a groove 75 on a periphery of the cooling oil chamber 64, a bank 76 is formed between the groove 75 and the cooling oil chamber 64.

An upper surface of the cooling oil chamber 64 is opened, and an open surface of the cooling oil chamber 64 is closed by a lid plate 68 which is joined to an upper end of the bank 76. The lid plate 68 is fixed to a boss 66 which is raised from the bottom surface of the cooling oil chamber 64 using a bolt 71. The boss 66 extends from an inner surface on one side of the cooling oil chamber 64 in the lateral direction to a center portion of the cooling oil chamber 64 thus forming the inside of the cooling oil chamber 64 into a U-shaped flow passage 67. Due to such a construction, the boss 66 to which the lid plate 68 is fastened also functions as a partition wall which forms the inside of the cooling oil chamber 64 having limited capacity into the relatively-elongated U-shaped flow passage 67. An inlet hole 69 which introduces oil into the cooling oil chamber 64 is opened on one end portion of the U-shaped flow passage, and an outlet hole 70 which discharges oil from the cooling oil chamber 64 is opened on the other end portion of the U-shaped flow passage respectively.

Oil in the oil reservoir 11 is supplied to the inlet hole 69 from an oil pump not shown in the drawing through a cylindrical oil passage 50 formed around one stud bolt 48 in the same manner as the respective lubrication oil passages. The outlet hole 70 is opened in the timing power transmission chamber 21. Further, a notch 77 which allows the groove 75 to be communicated with the cooling oil chamber 64 is formed in a portion of the bank 76 so that oil remaining on the bottom portion of the valve operating chamber 30 other than the cooling oil chamber 64 flows into the cooling oil chamber 64 from the groove 75.

The cooling oil chamber 64, the groove 75, the bank 76, the boss 66, the outlet hole 70 and the notch 77 are formed at the time of forming the cylinder head 3 by casting. More particularly, the cooling oil chamber 64, the groove 75 and the notch 77 have upper surfaces thereof opened. Thus, these parts can be easily formed by molding. Further, the outlet hole 70 is formed by molding using a core pin from a cooling oil chamber 64 side or a timing power transmission chamber 21 side and hence, to make the molding easier, the cooling oil chamber 64 is arranged such that both end portions of the U-shaped outlet hole 70 are directed toward the timing power transmission chamber 21 side. Further, the outlet hole 70 can be also easily formed by drilling from the cooling oil chamber 64 side or the timing power transmission chamber 21 side after forming the cylinder head 3 by casting.

Further, a second insertion recessed portion 86 for the second ignition plug 29*b* is formed such that the second insertion recessed portion 86 is opened on the back surface of the cylinder head 3 between the intake port 25 and the timing power transmission chamber 21. Accordingly, the second ignition plug 29*b* is threadedly mounted on a bottom wall of the cooling oil chamber 64, that is, on the partition wall 65 between the cooling oil chamber 64 and the combustion chamber 24 in a state where the second ignition plug 29*b* is inserted into the second insertion recessed portion 86.

Further, during driving of the engine E, lubrication oil for the engine flows into the U-shaped flow passage 67 defined in the cooling oil chamber 64 from the inlet hole 69 and flows out from the outlet hole 70 formed in the other end portion of the U-shaped flow passage 67 and flows into the timing power transmission chamber 21. Accordingly, oil circulates over the whole length of the relatively elongated U-shaped flow passage 67 defined in the cooling oil chamber 64 whereby it is possible to effectively cool the periphery of the cooling oil chamber 64 with oil. More particularly, since the second ignition plug 29*b* is threadedly mounted and arranged on the bottom wall of the cooling oil chamber 64, the second ignition plug 29*b* can be effectively cooled with oil. Oil which flows into the timing power transmission chamber 21 is finally returned to the oil reservoir 11.

Further, after finishing the lubrication of the valve operating mechanism 31, oil falls onto the bottom portion of the valve operating chamber 30 and flows down into the timing power transmission chamber 21. Here, oil which stays on the bottom portion of the valve operating chamber 30 flows into the cooling oil chamber 64 from the groove 75 formed on the periphery of the cooling oil chamber 64 through the notch 77 formed in the bank 76, and flows out from the outlet hole 70 and flows into the timing power transmission chamber 21 together with oil in the inside of the cooling oil chamber 64. Accordingly, it is possible to prevent oil from remaining on the bottom portion of the valve operating chamber 30 thus avoiding the degradation of oil attributed to the retention of oil.

The air flow passage 63 and the cooling oil chamber 64 which are formed for cooling the first and second ignition plugs 29*a*, 29*b* respectively can be relatively freely formed in the cylinder head 3 corresponding to the arrangement of the first and second ignition plugs 29*a*, 29*b*. Accordingly, it is possible to effectively cool the first and second ignition plugs 29*a*, 29*b* individually while increasing the degree of freedom in the arrangement of the first and second ignition plugs 29*a*, 29*b*. Accordingly, the durability of the first and second ignition plugs 29*a*, 29*b* can be enhanced thus, eventually, contributing to the enhancement of output performance and low fuel consumption of the engine. More particularly, the second ignition plug 29*b* is cooled by oil and hence, the second ignition plug 29*b* can be mounted on a back surface side of the cylinder head 3 where the flow of air hardly passes whereby it is possible to make use of a dead space formed behind the cylinder head 3 as a working space for mounting or dismounting the second ignition plug 29*b*.

Further, the inlet 63*a* of the air flow passage 63 is opened on the front surface of the cylinder head 3 such that the inlet 63*a* is arranged adjacent to the exhaust port 26 and, at the same time, the outlet 63*b* of the air flow passage 63 is opened on one side surface of the cylinder head 3 in the lateral direction, and the outlet 63*b* constitutes the first insertion recessed portion for the first ignition plug 29*a*. Accordingly, the first ignition plug 29*a* can be easily mounted on or dismounted from one side of the cylinder head 3 in the lateral direction whereby the first ignition plug 29*a* possesses an extremely excellent maintenance property.

Further, the second insertion recessed portion 86 for the second ignition plug 29*b* is formed on the back surface of the cylinder head 3 such that the second insertion recessed portion 86 is opened adjacent to the intake port 25. Thus, the second ignition plug 29*b* can be easily mounted on or dismounted from the back surface side of the cylinder head 3 whereby the second ignition plug 29*b* possesses an extremely excellent maintenance property. Further, the second insertion recessed portion 86 is arranged so as to be interposed between the intake port 25 and the timing power transmission chamber 21. Thus, the second insertion recessed portion 86 can be formed by effectively making use of a dead space formed between the intake port 25 and the timing power transmission chamber 21 thus obviating the large-sizing of the cylinder head 3.

Further, the exhaust port 26 is formed such that the downstream end of the exhaust port 26 is inclined toward the timing power transmission chamber 21 which is formed on one side portion of the cylinder head 3 in the lateral direction, and the air flow passage 63 is arranged on a side opposite to the timing power transmission chamber 21 with the exhaust port 26 sandwiched therebetween. Accordingly, an inlet of the air flow passage 63 can be largely opened without being obstructed by the exhaust port 26. Due to such a constitution, a flow rate of the flow of air which passes through the air flow passage 63 can be increased. Thus, it is possible to enhance the cooling property of the first ignition plug 29*a*.

Further, the cooling oil chamber 64 is formed on the bottom surface of the valve operating chamber 30 between the pair of left and right camshaft holders 52*a*, 52*b* which rotatably supports the camshaft 32 thereon, and the second ignition plug 29*b* is arranged directly below the cooling oil chamber 64. Accordingly, it is possible to easily form the cooling oil chamber 64 having a sufficient capacity on the bottom surface of the valve operating chamber 30 whereby the cooling property of the second ignition plug 29*b* can be further enhanced. Such an oil-cooled-type cooling device for the second ignition plug 29*b* is applicable to any types of engines such as a water-cooled type engine or an air-cooled-type engine.

Although the embodiment of the present invention has been explained heretofore, the present invention is not limited to the above-mentioned embodiment, and various design changes are conceivable without departing from the gist of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An ignition plug cooling device of a vehicle engine wherein a first ignition plug and a second ignition plug with respective electrodes face a combustion chamber are mounted on a cylinder head having the combustion chamber and an intake port and an exhaust port which open in the combustion chamber, comprising:

an air flow passage through which a flow of air passes and a cooling oil chamber through which lubrication oil for the engine passes are formed in the cylinder head;

the first ignition plug is arranged in the air flow passage so as to enable a cooling of the first ignition plug by the flow of air passing through the air flow passage; and the second ignition plug is arranged adjacent to the cooling oil chamber so as to enable a cooling of an area around the second ignition plug by oil passing through the cooling oil chamber.

2. The ignition plug cooling device for a vehicle engine according to claim 1, wherein an upstream end of the intake port is opened on a back surface of the cylinder head which faces a rear side of a vehicle, a downstream end of the exhaust port is opened on a front surface of the cylinder head which faces a front side of the vehicle, an inlet of the air flow passage is opened on the front surface of the cylinder head wherein the inlet is arranged adjacent to one side of the exhaust port, an outlet of the air flow passage is opened on one side surface of the cylinder head in a lateral direction, the outlet constitutes a first insertion recessed portion for inserting the first ignition plug to be arranged in the air flow passage, and a second insertion recessed portion for inserting the second ignition plug is opened on the back surface of the cylinder head wherein the second insertion recessed portion is arranged adjacent to one side of the intake port.

3. The ignition plug cooling device for a vehicle engine according to claim 2, wherein the exhaust port is formed such that the downstream end of the exhaust port is inclined toward a timing power transmission chamber for operating valves which are formed on one side portion of the cylinder head in a lateral direction, and the air flow passage is arranged on a side opposite to the timing power transmission chamber with the exhaust port sandwiched between the timing power transmission chamber and the air flow passage.

4. The ignition plug cooling device for a vehicle engine according to claim 3, wherein the air flow passage is formed into an approximate L shape wherein the inlet of the air flow passage is opened on the front surface of the cylinder head on a side opposite to the timing power transmission chamber.

5. The ignition plug cooling device for a vehicle engine according to claim 3, wherein the outlet of the air flow passage is opened on a left-side surface of the cylinder head on a side opposite to the timing power transmission chamber.

6. The ignition plug cooling device for a vehicle engine according to claim 5, wherein the outlet of the air flow passage is a first insertion recessed portion for the first ignition plug.

7. The ignition plug cooling device for a vehicle engine according to claim 2, wherein the second insertion recessed portion is arranged between the intake port and a timing power transmission chamber for operating valves which are formed on one side portion of the cylinder head in a lateral direction.

8. The ignition plug cooling device for a vehicle engine according to claim 1, wherein the cooling oil chamber is arranged between a pair of left and right camshaft holders formed on the cylinder head and rotatably supporting a valve operating camshaft, and the second ignition plug is arranged directly below the cooling oil chamber.

9. The ignition plug cooling device for a vehicle engine according to claim 1, wherein the second ignition plug is mounted on a partition wall formed between the cooling oil chamber and the combustion chamber wherein the second ignition plug is arranged directly below the cooling oil chamber.

10. The ignition plug cooling device for a vehicle engine according to claim 9, wherein the cooling oil chamber is formed on a bottom surface of a valve operating chamber by indentation between a pair of left and right camshaft holders with a bank being formed between a groove and the cooling oil chamber and a lid plate being positioned on said bank for closing the cooling oil chamber.

11. An ignition plug cooling device for a vehicle engine comprising:

a first ignition plug and a second ignition plug mounted on a cylinder head having a combustion chamber;

an intake port and an exhaust port opening into the combustion chamber;

an air flow passage formed in the cylinder head for directing a flow of air;

a cooling oil chamber formed in the cylinder head for directing lubrication oil;

the first ignition plug is arranged in the air flow passage for enabling a cooling of the first ignition plug by the flow of air passing through the air flow passage; and the second ignition plug is arranged adjacent to the cooling oil chamber for enabling a cooling of an area around the second ignition plug by oil passing through the cooling oil chamber.

12. The ignition plug cooling device for a vehicle engine according to claim 11, wherein an upstream end of the intake port is opened on a back surface of the cylinder head which faces a rear side of a vehicle, a downstream end of the exhaust port is opened on a front surface of the cylinder head which faces a front side of the vehicle, an inlet of the air flow passage is opened on the front surface of the cylinder head wherein the inlet is arranged adjacent to one side of the exhaust port, an outlet of the air flow passage is opened on one side surface of the cylinder head in a lateral direction, the outlet constitutes a first insertion recessed portion for inserting the first ignition plug to be arranged in the air flow passage, and a second insertion recessed portion for inserting the second ignition plug is opened on the back surface of the cylinder head wherein the second insertion recessed portion is arranged adjacent to one side of the intake port.

13. The ignition plug cooling device for a vehicle engine according to claim 12, wherein the exhaust port is formed such that the downstream end of the exhaust port is inclined toward a timing power transmission chamber for operating valves which are formed on one side portion of the cylinder head in a lateral direction, and the air flow passage is arranged on a side opposite to the timing power transmission chamber with the exhaust port sandwiched between the timing power transmission chamber and the air flow passage.

14. The ignition plug cooling device for a vehicle engine according to claim 13, wherein the air flow passage is formed into an approximate L shape wherein the inlet of the air flow passage is opened on the front surface of the cylinder head on a side opposite to the timing power transmission chamber.

15. The ignition plug cooling device for a vehicle engine according to claim 13, wherein the outlet of the air flow passage is opened on a left-side surface of the cylinder head on a side opposite to the timing power transmission chamber.

16. The ignition plug cooling device for a vehicle engine according to claim 15, wherein the outlet of the air flow passage is a first insertion recessed portion for the first ignition plug.

17. The ignition plug cooling device for a vehicle engine according to claim 12, wherein the second insertion recessed portion is arranged between the intake port and a timing power transmission chamber for operating valves which are formed on one side portion of the cylinder head in a lateral direction.

18. The ignition plug cooling device for a vehicle engine according to claim 11, wherein the cooling oil chamber is arranged between a pair of left and right camshaft holders formed on the cylinder head and rotatably supporting a valve operating camshaft, and the second ignition plug is arranged directly below the cooling oil chamber.

19. The ignition plug cooling device for a vehicle engine according to claim 11, wherein the second ignition plug is mounted on a partition wall formed between the cooling oil chamber and the combustion chamber wherein the second ignition plug is arranged directly below the cooling oil chamber.

20. The ignition plug cooling device for a vehicle engine according to claim 19, wherein the cooling oil chamber is formed on a bottom surface of a valve operating chamber by indentation between a pair of left and right camshaft holders with a bank being formed between a groove and the cooling oil chamber and a lid plate being positioned on said bank for closing the cooling oil chamber.

* * * * *